US005240106A

United States Patent [19]

Plath

[11] Patent Number: 5,240,106

[45] Date of Patent: Aug. 31, 1993

[54] CAMERA BAG

[75] Inventor: Robert V. Plath, Lighthouse Point, Fla.

[73] Assignee: Eiffel Design, Inc., Deerfield Beach, Fla.

[21] Appl. No.: 925,600

[22] Filed: Aug. 4, 1992

[51] Int. Cl.[5] ..... B65D 85/38; A45G 5/14; A45G 5/12

[52] U.S. Cl. ..... 206/316.2; 190/18 A; 190/903; 190/31; 190/113; 190/115; 190/102; 190/108

[58] Field of Search ..... 206/316.2; 190/18 A, 190/115, 903, 31, 16, 17, 113

[56] References Cited

U.S. PATENT DOCUMENTS

| | | | |
|---|---|---|---|
| 344,212 | 6/1886 | Stephens | 190/31 X |
| 3,185,271 | 5/1965 | Kotkins | 190/113 |
| 4,883,207 | 11/1989 | McArthur | 190/113 X |
| 4,995,487 | 2/1991 | Plath | 190/18 A |
| 5,083,645 | 1/1992 | Lee | 190/113 |
| 5,167,306 | 12/1992 | Carrigan, Jr. | 190/18 A |

*Primary Examiner*—William I. Price
*Attorney, Agent, or Firm*—Jones & Askew

[57] ABSTRACT

A camera bag having a substantially rigid rectilinear well with a plurality of rigid bins disposed therein. The bins are mounted for rotation about horizontal axes disposed toward the front of the bag and may be selectively rotated between a home position in which they fit in the interior of the bag and an open position at which their contents may be easily accessed. Apparatus for maintaining the bins and both their open and home position is disclosed. A retractable U-shaped handle having telescoping rods is used to pull the bag on a pair of wheels when desired. The telescoping rods become journaled in tubular guides disposed within the interior of the bag. Removable side pockets are particularly designed for carrying lenses and specifically designed to be quickly removed from the sides of the bag and carried on the belt of a user.

29 Claims, 5 Drawing Sheets

CAMERA BAG

TECHNICAL FIELD

The present invention relates generally to luggage, and more particularly to a type of luggage particularly suited for carrying and protecting photographic equipment.

BACKGROUND OF THE INVENTION

In the last 20 years, the single lens reflex (SLR) 35 mm camera has become a de facto standard for many professional photographers as well as thousands of amateurs. Photographers with any serious interest in the finer nuances of the art of photography tend to use at least one camera body, and often several, and several interchangeable lenses. A typical complement of lenses includes at least one fixed focal length lens and at least one with a zoom characteristic over a range of focal lengths. Most professional photographers will want to carry multiple camera bodies into the field when performing a job, particularly when there is action involved and there is not time to change lenses while shooting different pictures requiring lenses of differing focal lengths and aperture characteristics. Additionally, many photographers will use lenses of differing apertures in order to provide various depths of field under various light conditions.

Proliferation of the use of interchangeable lens single lens reflex cameras has led to a corresponding growth in the use of pieces of luggage for carrying and storing camera equipment. In particular, prior camera carrying bags have tended to fall into two categories. The first is soft-sided bags with selectively moveable and attachable partitions that are designed to carry at least one camera body and have the selectively locatable partitions segment the volume of the bag to accommodate multiple lenses. Many such bags have an external pocket permanently attached thereto for holding film. Such bags are normally carried either by a handle or shoulder strap.

Some professional photographers have used hard sided cases with customized foam inserts with cutouts for accepting particular lenses, camera bodies, accessories and the like. These are particularly suited for carrying relatively large volumes of camera equipment when traveling. For example, storage of camera equipment in such a hard sided foam lined case is useful for transporting the camera equipment as checked baggage on airplanes. However, bags of this type designed to carry multiple camera bodies and multiple lens alternatives, together with accessories such as a significant supply of film and various filters, tend to be relatively large. Also, such pieces of camera carrying luggage typically are hinged in either a clam shell manner or along the longest dimension of a pair of rectangular panels and thus, need to be opened completely before their contents can be accessed. Thus, it is often difficult when carrying camera equipment in such luggage to be able to access the appropriate body and lens, in relatively cramped quarters, such as traveling on a vehicle to a shooting location.

Thus, the prior art use of customized hard sided luggage for transporting a significant amount of camera equipment, particularly by professionals, is effective but lacks some of the conveniences of other forms. The cases tend to be relatively large and are rarely appropriate for carrying on to an airplane when a significant amount of equipment such as multiple camera bodies and multiple lenses, are carried. Additionally, changes in the photographer's compliment of equipment when using such bags requires modification of the custom lining of the case. The use of soft bags carried via handles or shoulder straps tends to be easier to carry on, but often leads to configurations where multiple bags must be carried in order to carry a sufficient compliment of equipment for many professional photography jobs. Since many professional photographers fly by commercial air travel to various job locations, it is desirable to provide an improved camera bag with a capacity similar to that of prior art hard sided foam lined cases, some of the convenience, both with respect to access and carrying, of soft sided bags, and which may be conveniently carried on to the passenger cabin of an airplane as carry-on luggage.

Most professional photographers desire the ability to carry as much camera equipment into the field while performing their work under circumstances that do not exhaust the photographer from the job of carrying. Therefore, it is highly desirable to have a camera bag for use by a professional photographer which has a high capacity, including the ability to provide the photographer with ready access to multiple camera bodies fitted with different lenses. It is further important that such a bag be arranged for rapid opening and closure and easy carrying in the field. The present invention meets this need as well as providing some additional features of utility and convenience.

SUMMARY OF THE PRESENT INVENTION

The present invention fulfills the above stated need by providing a piece of luggage particularly designed for hauling photographic equipment. It is sized to be similar to that described in the present inventor's U.S. Pat. No. 4,995,487, issued Feb. 26, 1991, entitled "WHEELED SUITCASE AND LUGGAGE SUPPORT". In its preferred form, it employs multiple equipment bins that are pivotally mounted for rotation about axes of rotations parallel to the ground when the bag is in its upright position. The bins are preferably rigid and include apparatus for retaining them securely in either home position in which they are rotated into the interior of the volume of the bag. It also includes apparatus for securing the bins in an open position at which the contents of the bins are easily accessible, but which also prevents them from rotating fully to dump their contents.

The present invention includes a pair of spaced apart parallel rigid vertical side walls and a pair of spaced apart rigid parallel top and bottom walls defining an interior volume. These are preferably constructed by molding a single piece of hard plastic, although other forms may be used. A vertical back wall is preferably made of reinforced cloth or some other semisoft material. The present invention includes a pair of roller type wheels, preferably disposed on one of the bottom edges with a retractable U-shaped handle, preferably having multiple telescoping vertical stanchions at the opposite end thereof. This allows the bag to be conveniently rolled when walking from place to place with it. Additionally, the preferred forms of the present invention include a plurality of points for attaching back and shoulder straps so that the bag may be carried on the user's back or shoulder.

In its preferred form, at least one removable tray is inserted under the lower most pivotally mounted bin, which tray is particularly sized for carrying boxes of film. The depth of such tray is selected so that its forward edge will be behind the axis of rotation of the lower bin when the tray is fully inserted into the interior of the bag. This allows the lower bin to be rotated from its home position to its open position without interference by the tray.

In preferred forms of the present invention, it is closed by a front flap located opposite the vertical back wall, which is permanently attached along the lower edge to the body of the case and selectively closeable via a peripherally mounted zipper on the other three edges. In the preferred form, the front flap includes two reinforced portions which will fold to allow selective access only to the upper bin when desired, as well as access to both the upper and lower bins and the entirety of the interior of the bag. Also, the folding allows the bag to be opened in relatively cramped quarters unlike hard sided professional camera cases used in the prior art.

In preferred forms of the present invention, the retractable telescoping stanchions of the U-shaped handle fit inside guide tubes that are within the interior of the bag. Detents in the rotatable bins engage the guide tubes when the bins are rotated to their home position.

In preferred forms, relatively long externally attachable pouches are used to store long focal length lenses.

These pouches are detachable and may be worn on the belt of the user when detached from preferred embodiments of the present invention. This allows the lenses to be carried conveniently and safely carried in a protective pouch on the belt of the user while working in the field and to have these pouches detached from the belt and reconnected to the camera bag of the present invention for subsequent transportation.

In preferred forms of the present invention, the outer closing flap is fitted with one portion of hook and eye fiber straps that are selectively attachable to liners for the above referenced bins. This allows the bag to be carried on the user's shoulder via an optional shoulder strap so that a slight outward pull of the covering flap will, through the action of the strap, cause the bin to open quickly for access to another camera body. This may be quickly removed and the camera body previously in use can be reinserted and, with quick motion of the hand, the bin can be reshut and the new camera body can be prepared for shooting.

The preferred form of the present invention is fitted with both the above referenced U-shaped retractable handle and a more conventional handle on the top. This, combined with shoulder strap and connector strap attachments provide five ways in which preferred forms of the present invention may be transported. First, the bag may be slung over the user's shoulder. This may be used for simply transporting the bag, or using while in the field shooting with the bag partially open and the bins ready to be opened and closed quickly for access to the contents of the bag. Secondly, the same strap arrangement may be used for toting the bag on the user's back. This is normally used in the field for toting the bag over relatively long distances during which access to its contents is not required.

Thirdly, the bag may be carried by its conventional handle in a manner similar to a conventional suitcase. Additionally, the bag may be rolled over appropriate terrain by use of the retractable U-shaped handle and the integral wheels on the bottom thereof.

Lastly, the bag is fitted with connection straps so that it may be attached to, and carried by another piece of rollable luggage equipped with a compatible connection system.

Therefore, it is an object of the present invention to provide an improved camera bag having an equipment capacity similar to that of prior art hard sided bags with many of the carrying and access conveniences associated only with soft sided bags in the prior art.

It is a further object of the present invention to provide a large volume camera bag particularly suited for use as carry-on luggage on a commercial aircraft.

It is a further object of the present invention to provide an improved camera bag that provides easy access to the equipment it contains even when the user is in relatively cramped quarters and has a limited space in which to expand the open components of the bag.

That the present invention meets these objects and overcomes some of the above noted drawbacks of the prior art will be appreciated from the detailed description of the preferred embodiment which follows.

DETAILED DESCRIPTION OF THE PREFERRED EMBODIMENT

Figure 1:
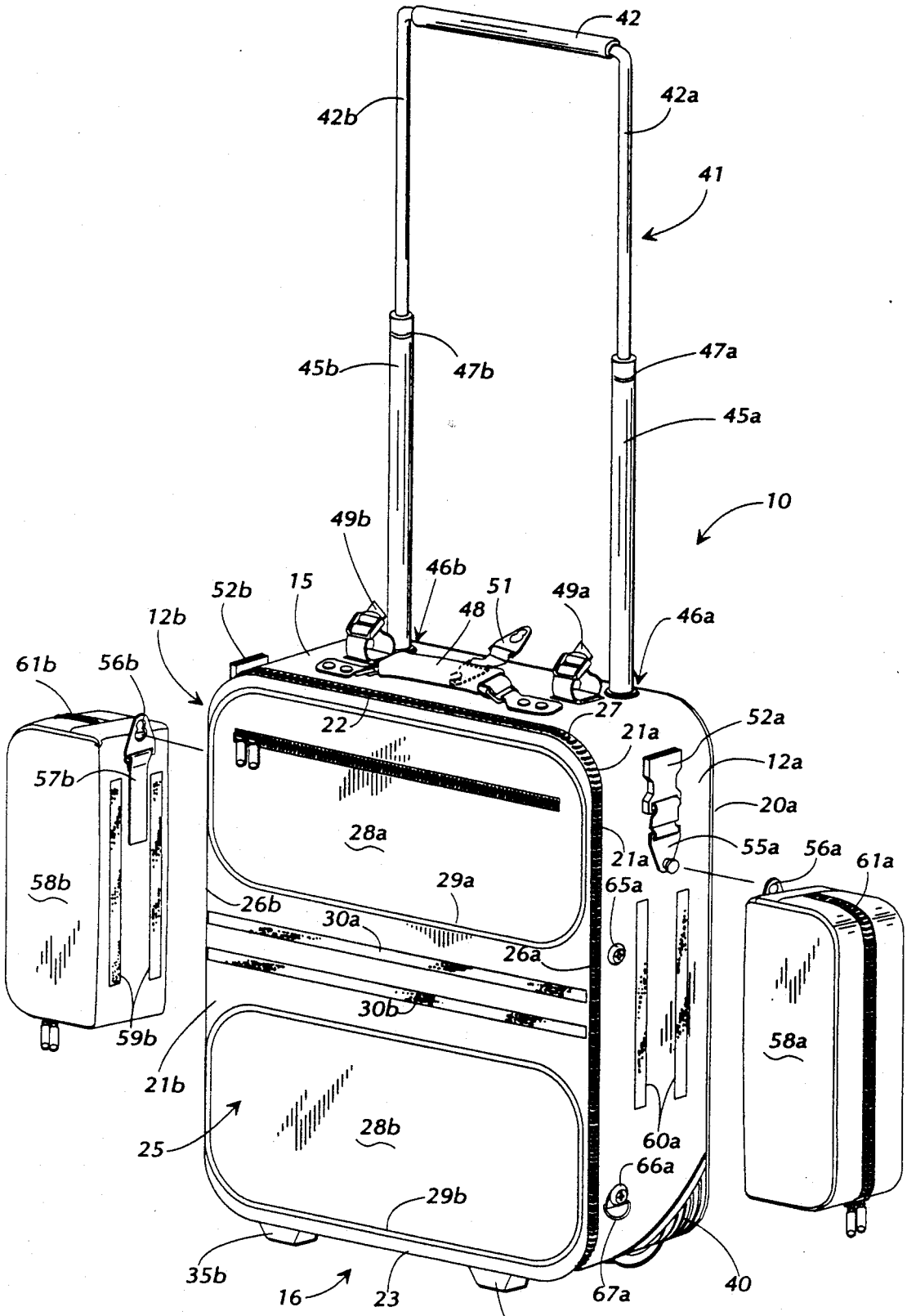
FIG. 1 is a pictorial view of the front of the preferred embodiment of the present invention.
Figure 2:
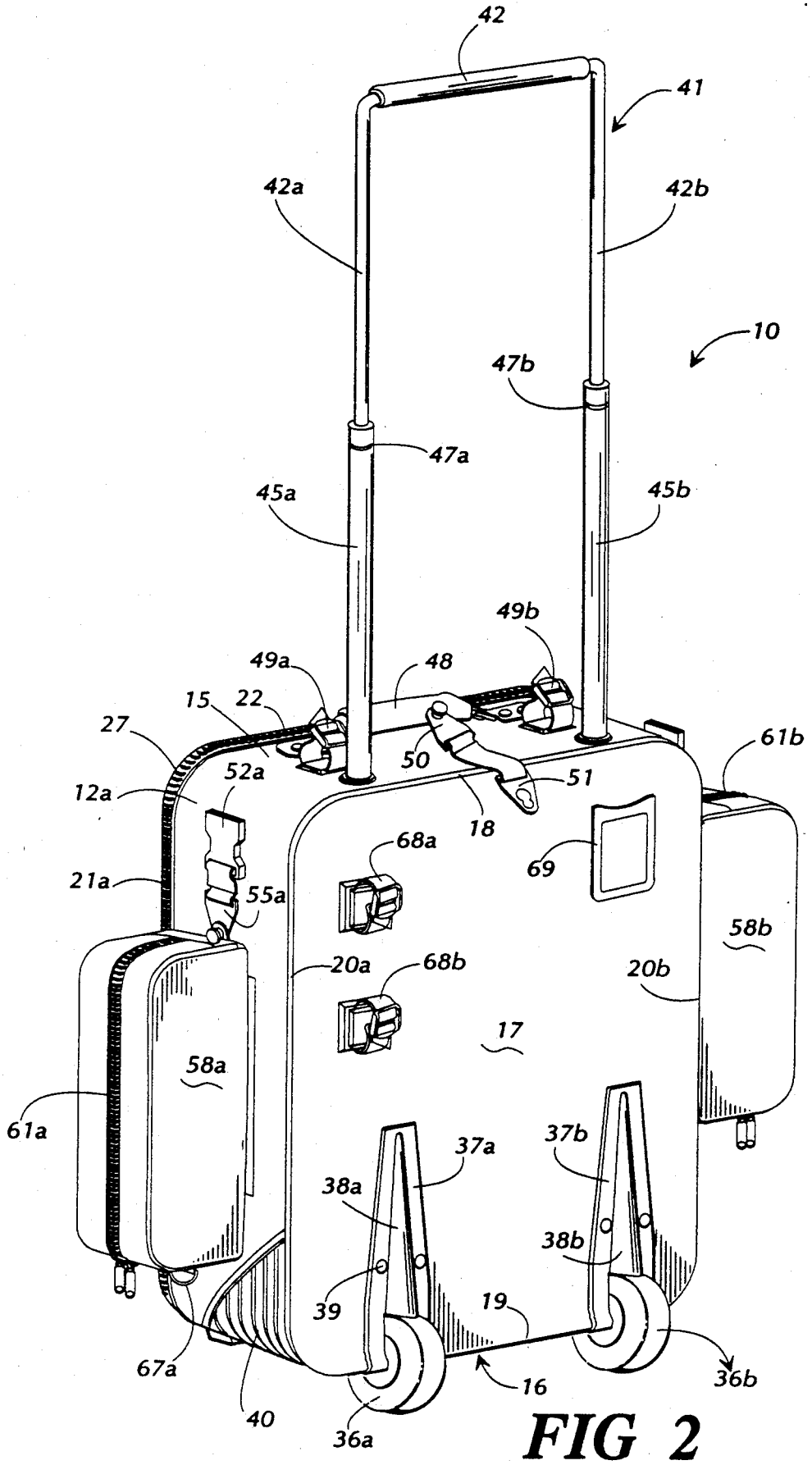
FIG. 2 is a pictorial view of the back of the present invention.

Turning now to the drawing figures in which like numerals represent like parts, the preferred embodiment of the present invention will now be described. As illustrated in FIGS. 1 and 2, the preferred embodiment is a camera bag enclosing a generally rectangular volume. It comprises a substantially rectangular well constructed of a pair of rigid opposing vertical side walls 12*a* and 12*b*. It also includes a rigid top wall 15 and a substantially rigid bottom wall 16 that is substantially parallel thereto. A substantially rectangular vertical back wall 17 is joined to top wall 15 at its back edge 18 and to the bottom wall 16 at its back edge 19. Similarly, the back wall 17 joins the vertical side walls 12 at their back edges 20*a* and 20*b*. Therefore, all of back edges 18–20 join substantially rectangular back wall 17 to define the well of the case.

Vertical side walls 12 also have respective front edges 21*a* and 21*b* that are contiguous with front edges 22 and 23 of the top and bottom walls, respectively. A front flap 25 has a bottom edge that is joined to the front edge 23 of the bottom wall and a pair of vertical side edges 26*a* and 26*b* that join front edges 21*a* and 21*b*, respectively, of the vertical side walls. Thus, the periphery of the rectangular well is defined by front edges 21, 22, and 23, and is joined to the periphery of front flap 25 when the bag is closed. Along edges 21*a* and 21*b* of vertical side walls 12 and front edge 22 of top wall 15, a zipper 27 is employed for selectively opening and closing the interior of the well.

The front flap is divided into two distinct reinforced portions 28*a* and 28*b*. In the preferred embodiment reinforcement is provided to the respective portions by respective sets of peripheral piping 29*a* and 29*b*. In the preferred embodiment, front flap 25 is constructed of a strong, but essentially non-rigid, cloth material such as woven nylon. The piping sets 29*a* and 29*b* each comprise a reinforcing metal wire surrounded by plastic that is glued or sewn onto the respective portions 28 to define each of them as a semi-rigid portion of the front flap 25.

A pair of horizontally disposed leather or plastic strips 30*a* and 30*b* are sewn across the central area of front flap 25 that lies between semi-rigid portions 28*a* and 28*b*. These reinforcing strips have the effect of defining a hinge that allows the portions 28*a* and 28*b* to rotate about a horizontal axis with respect to each other, as described more fully hereinbelow.

When the camera bag of the preferred embodiment is in its vertical position, as illustrated in the drawing figures, it rests on a pair of front legs 35*a* and 35*b* and rearwardly disposed roller-type wheels 36*a* and 36*b* located proximate rigid bottom wall 16. In the preferred embodiment, wheels 36 cut the line formed by the intersection of bottom edge 19 of vertical rear wall 17 and the back edge of the rigid bottom wall 16.

In the preferred embodiment, the wheels 36 are mounted on a unitary molded fender assemblies 37*a* and 37*b*. These fenders include portions 38*a* and 38*b* that project outwardly from rear wall 17. In use, when the bag is pulled along rolling on wheels 36, and the user encounters a staircase or some other sudden vertical displacement in the terrain over which the bag is being transported, the outwardly projecting portions 38 may be used to engage the front edge of the stairs or other obstacle so that the bag may be dragged up and over such front edge. When this occurs, the outwardly projecting portions 38 of fender assemblies 37 bear the frictional contact with the obstacle over which the bag is being hauled and thus, help protect back wall 17. Additionally, since the projecting portions 38 of fenders 37 stick out rearwardly over a significant portion of the wheels 36, they assure that the wheel will engage the top surface of the obstacle at an acute angle which will thus allow rolling of the bag to recommence relatively easily. Prior rollable luggage is often arranged so that the corresponding contact with wheels when the bag is being lifted over the front edge of a stair puts a force that is substantially radial on the wheel. If the user drags the bag in any rapid or rough manner, this can damage the wheel, bend the axle, or otherwise tend to cause failure of the wheel assembly. In the preferred embodiment, the fender assemblies 37 are made of injection molded plastic and they are attached to rigid back wall 17 via plastic rivets, an exemplary one of which is indicated at 39 on fender assembly 37*a*.

For protection during rolling, a pair of molded plastic corner protectors are provided the right side, one of which is indicated at 40 in FIGS. 1 and 2. These help prevent excessive wear on the areas they cover when the bag is rocked from side to side during rolling or it is dragged along sideways over an obstacle or along the ground, for example, when the user is standing in a queue.

The preferred embodiment includes a substantially U-shaped handled, indicated generally at 41. The top of the handle is preferably covered by a soft covering indicated at 42. The sides of the handle are composed of pairs of telescoping spaced apart elongated rod members 42*a* and 45*a*, and 42*b* and 45*b*. The smaller diameter portions 42 are journaled within the hollow interiors of portions 45, which in turn are inserted through openings 46*a* and 46*b* into a pair of tubular guides (not shown in FIGS. 1 and 2) within the interior of the bag. Each of portions 45 of the rod members has a respective retaining clip 47 connected about its periphery that is used to engage a stop (not shown) on the ends of sections 42 of the elongated rods forming handle 41.

In addition to retractable U-shaped handle 41, a conventional suitcase handle 48 is provided on top of top wall 15. This allows the user to insert U-shaped handle 41 into the interior of the bag and carry it by grasping handle 48 as if it were a conventional suitcase.

Additionally, a pair of selectively detachable loops 49*a* and 49*b* are provided on the top. These may be used to attach external articles such as tripods, umbrellas, or folding cloth flash reflectors to the bag when in use. An auxiliary attachment system is included in the preferred embodiment consisting of post and eye connectors at opposite ends of a strap that is secured to the top wall 15 of the bag. The post connector 50 is normally used to attach other auxiliary carrying devices or bags to the bag of the preferred embodiment. A corresponding eye connector 51 is used to connect the bag of the preferred embodiment to other luggage equipped with a mating post connector so that the preferred embodiment may be carried piggyback on top of other luggage. Therefore, the combination of post and eye connectors 50 and 51 allow other bags to be piggybacked on the preferred embodiment or the preferred embodiment to be piggybacked on other bags.

Secured to vertical side walls 12 are a pair of female portions of 52*a* and 52*b* of quick release snap lock connectors. In the preferred embodiment, these are used to mate with corresponding male portions that are provided on the ends of an auxiliary shoulder strap (not shown). The shoulder strap is preferably padded and allows the bag to be carried either over the shoulder of the user, or over both shoulders with the strap going behind the user's neck so that it is carried in the manner of a backpack.

Connected to the same straps carrying female connectors 52 are stud connectors 55 that mate with eye connectors 56 that are attached to the ends of straps 57, (strap 57*b* being visible in FIG. 1) which are in turn sewn to a pair of side pouches 58*a* and 58*b*. As is visible in the drawing of side pouch 58*b*, strips 59 of hook and eye fasteners mate with corresponding strips 60 disposed on the outside of vertical side walls 12. The present inventor designed side pouches 58 to carry long lens attachments, but of course they may be used to carry any apparatus desired by the user. Access to the interiors of the side pouches is obtained selectively through operation of zippers 61*a* and 61*b*.

In use, side pouches 58 may be very securely fastened to vertical side walls 12 by engaging eye connector 56 with stud connector 55 and aligning hook and eye strips 59 and 60 so that side pouches 58 are tightly secured to the vertical side walls.

It is also desired to construct these pouches so that they may be readily carried on the belt of a user in the field in order, for example, to allow a photographer to carry several lenses even when the bag has been left at a site and the photographer is walking. There are two desirable alternative ways to accomplish this. First, the top end of strap 57 forms a loop through which eye connector 56 is attached. In some embodiments of the present invention, the loop is elongated so that it is sufficiently long to accept passage of a belt therethrough. Alternatively, a stud connector similar to stud connectors 55 is fitted on its own looped strap for connection to a belt. This is the preferred arrangement in that it allows the user to quickly disconnect the side pouch 58 from the bag and connect it to this attachment to his or her belt without having to undo the belt and pass the tongue thereof through a loop at the top of strap 57.

Each of vertical side walls 12 has two through bolts 65 and 66 connected therethrough. Bolts 65*a* and 65*b* (FIG. 3) are aligned horizontally and each such pair defines a horizontal axis. Similarly, the lower bolts 66*a* and 66*b* on the respective side walls 12*a* and 12*b* define a second horizontal axis that lies below the first. The rotation of the rigid bins of the preferred embodiment about these horizontal axes and around the through bolts 65 and 66 is discussed in greater detail hereinbelow.

The head of each of bolts 66 is connected to a grommet that carries a metal ring 67 thereon. This pair of rings may be used for a number of purposes, including the attachment of straps that assist in the carrying of the bag. Additionally, the rings may be used to pass cords or other devices through when the bag needs to be secured to some of other piece of apparatus. Also, the rings may be used for passing cords at the end of slip knots so that a tripod or other elongated relatively thin device may be secured to the bottom of the bag when in use.

Turning for a moment to FIG. 2, another pair of straps 68 are provided on the outside of vertical back wall 17. These are preferably used for carrying tripods. An identification pocket 69 is provided so that written material bearing indicia identifying the owner of the bag may be inserted therein.

As noted hereinabove, side walls 21 and top and bottom walls 15 and 16, respectively, are rigid, preferably being constructed of a hard plastic material. Similarly, vertical back wall 17 is constructed of similar material. The preferred construction for embodiments of the present invention is to mold the side, top, and bottom walls of a single piece of hard plastic with a molded back wall 17, with appropriate slots for accepting fender assemblies 37 therein, and to ultrasonically weld or glue the back piece to the periphery of the walls. The well may be formed by molding the side, top, and bottom walls, together with the vertical back wall, from a single piece of plastic. It is preferred to then cover same with a web material, preferably made of the same material that is used to construct front panel 25.

Figure 3:
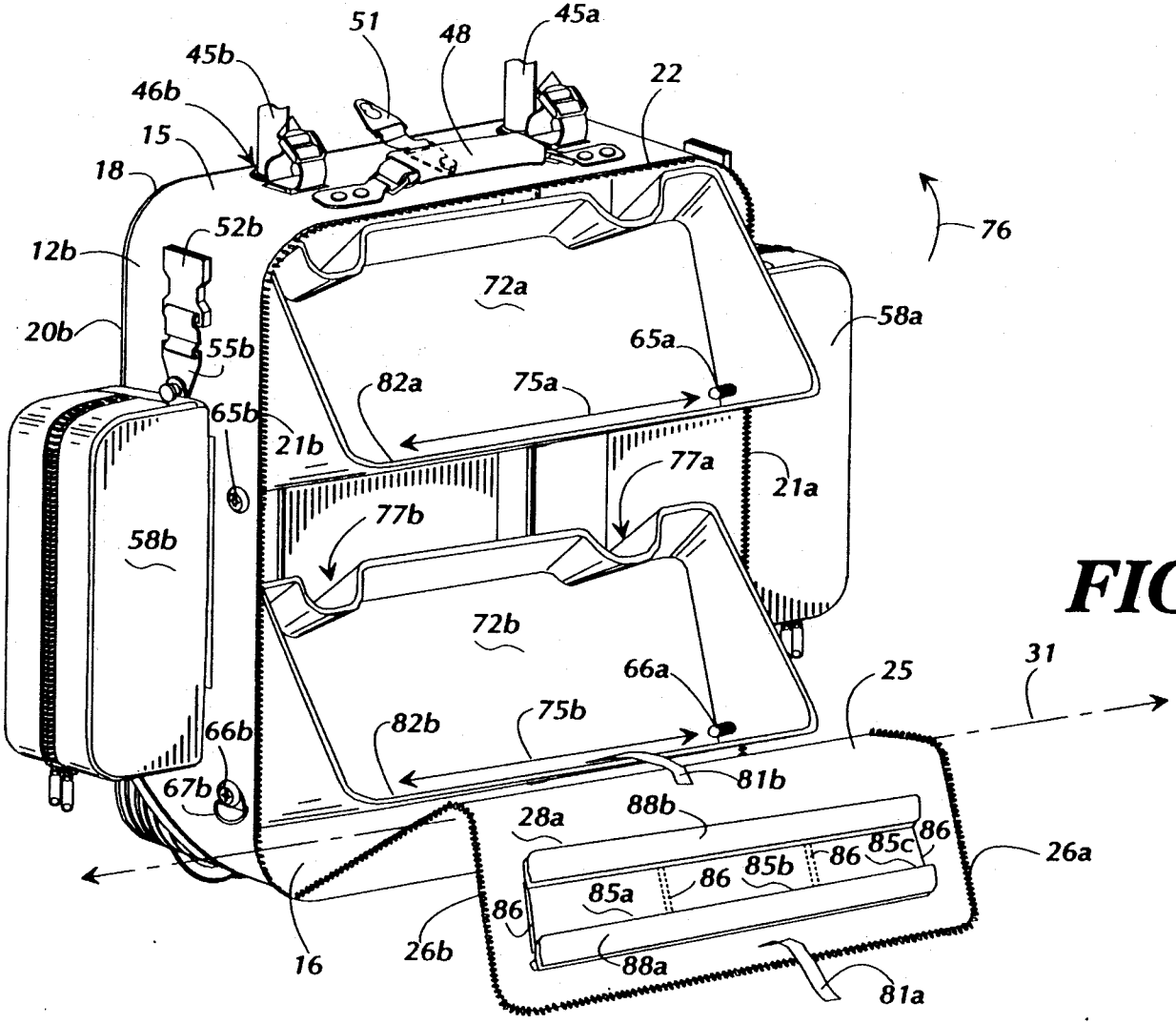
FIG. 3 is a pictorial view of the front of the preferred embodiment of the present invention with the front flap and bins open.
Figure 4:
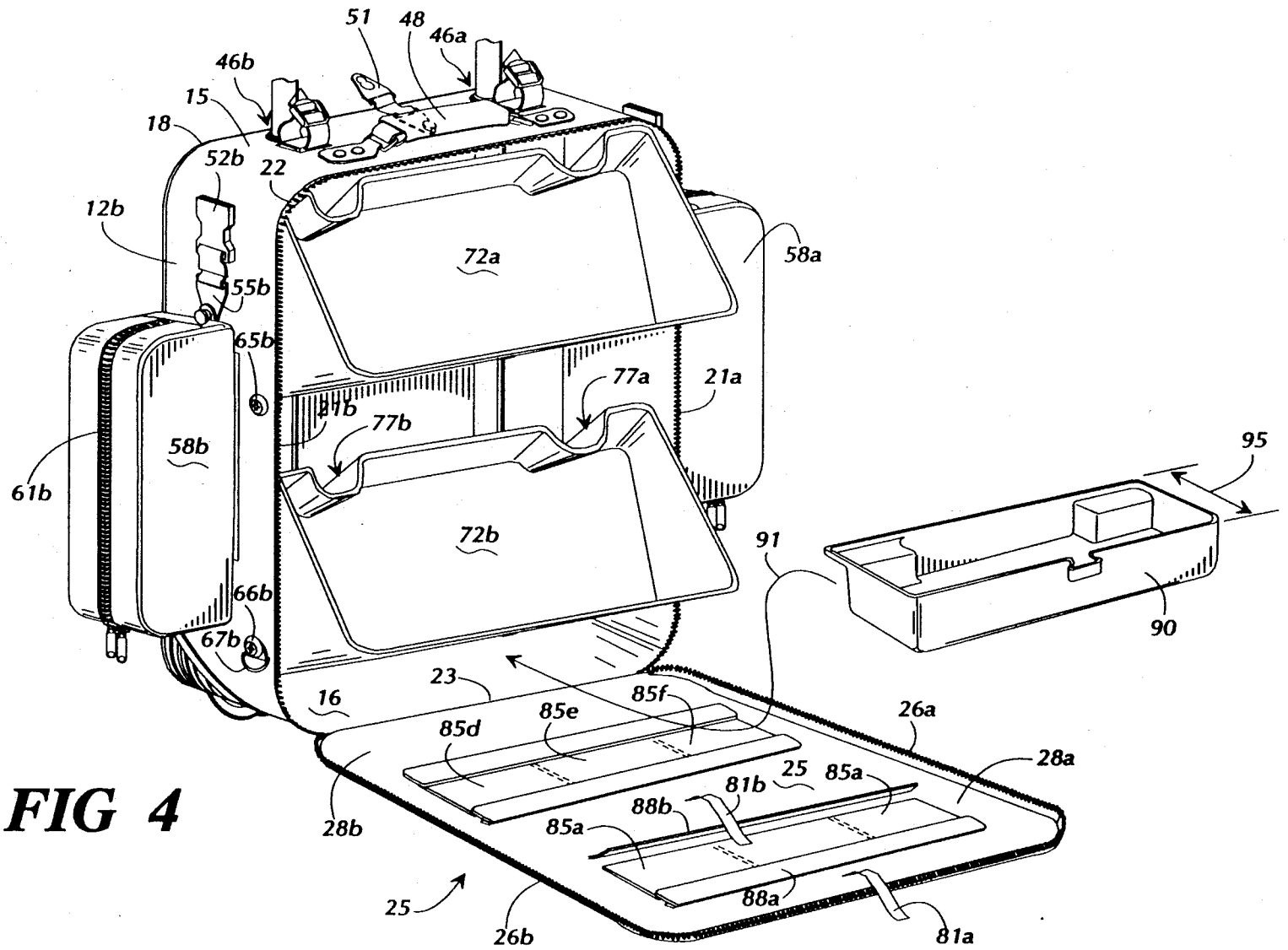
FIG. 4 is a pictorial view of the front of the preferred embodiment with the bins open and the covering flap laid all the way open.
Figures 5, 6:
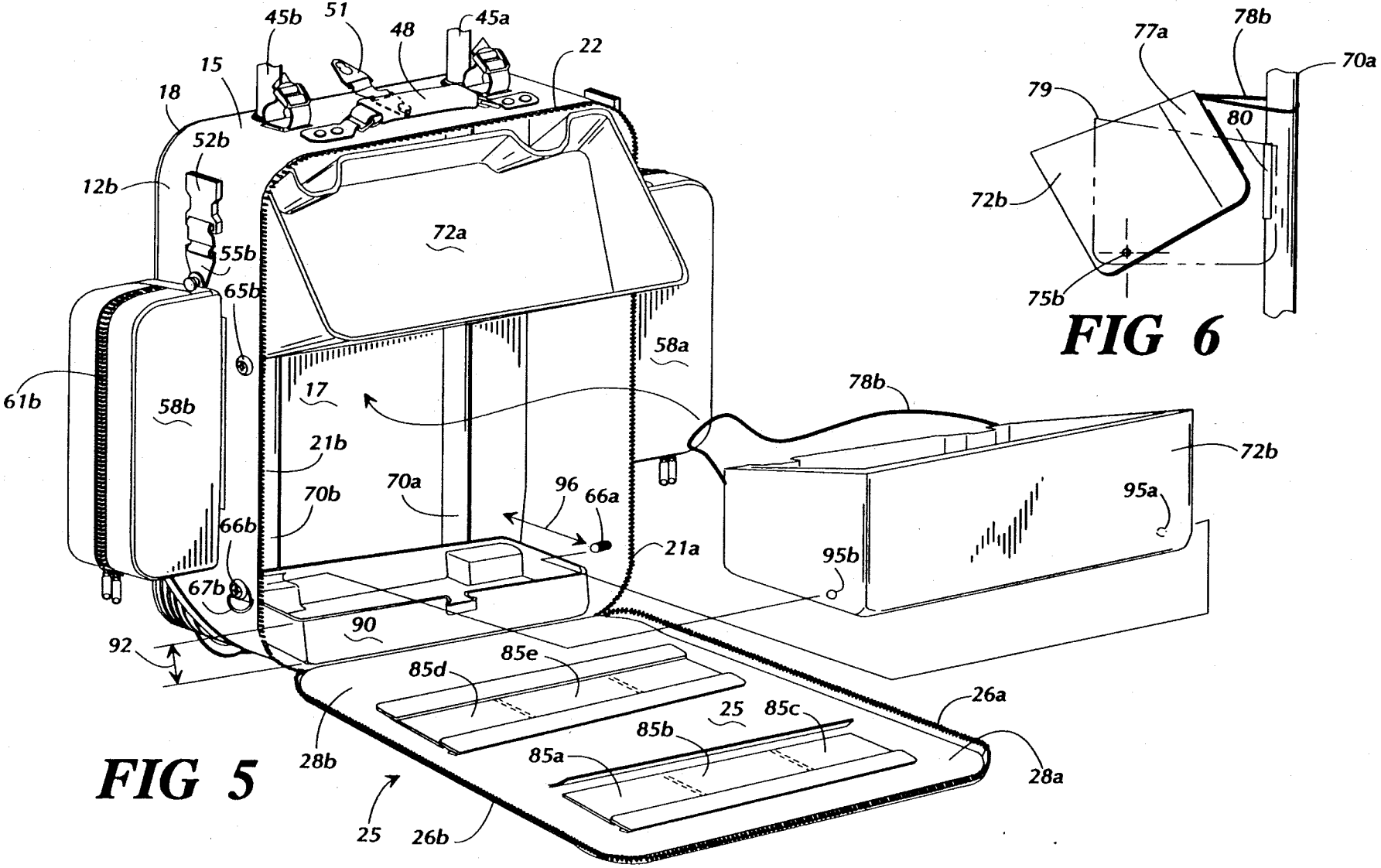
FIG. 5 is a pictorial view of the front of the preferred embodiment with the lower bin removed.
FIG. 6 is a detail view of the mounting arrangement for the bins employed in the preferred embodiment.

Turning next to FIGS. 3, 4, and 5, the apparatus in the interior of the preferred embodiment will now be explained. A pair of tubular guides 70*a* and 70*b* are disposed vertically within the interior of the preferred embodiment. A central longitudinal axis for tubular guides 70 aligns with the center of openings 46 so that rod members 45 and 42 are journaled within tubular guides 70 when U-shaped handle 41 is collapsed to its stored position at which the horizontal member covered by pad 42 is flush to top wall 15.

The main storage compartments within the interior of the bag 10 are rigid bins 72*a* and 72*b*. These are preferably formed from injection molded hard plastic. In FIG. 3, bins 72 are shown rotated outward to their open position. As may be seen in FIG. 3, bins 72 rotate on through bolts 65 and 66, which respectively form a pair of horizontal axes 75*a* and 75*b* about which the bins 72 rotate. When the bins are rotated into the interior of the preferred embodiment about axes 75, that is in the direction indicated by arrow 76 in FIG. 3, the bins sit at what is referred to as a home position in this specification.

Turning for a moment to FIG. 6, a detail of the mounting and rotation of the lower bin 72*b* is shown. The bin is shown in asserted form as rotated outward about axis 75*b* to its open position. It is restrained in this position by cord 78*b* that is looped around the back of both of tubular guides 70*a* and 70*b*. This cord is preferably connected to the bin by passing the ends thereof through a hole in the back wall of the bin and tying a knot of sufficient size to prevent passage of the end back through the hole.

The bin is also shown in phantom rotated to its home position, as indicated at 79 in FIG. 6. A strip of hook and eye material 80 is glued to post 70*a* and a corresponding strip (not shown) is glued to tubular guide 70*b*. A mating strip of hook and eye material (not shown) is on the lowest portion of detent 77*a*. Therefore, when bin 72*b* is rotated to the home position shown at 79, the strips of hook and eye material glued to the back of detent 77*a* on the back wall of bin 72 mates with strip 80 to secure the bin in its home position within the interior of the bag. Therefore, when the bins have been rotated back to their home position, the apparatus still resists spilling of the contents of the bins even if front flap 25 is open and the bag is tilted forward. The hook and eye connectors between detents 77 and tubular guides 70 prevents rotation outward to the open position solely in response to the force of gravity.

Returning again to FIGS. 3–5, some other salient features of the preferred embodiment will be described. A pair of straps of hook and eye material 81*a* and 81*b* are secured to the interior of front flap 25. In use, bins 72*a* and 72*b* are preferably lined with cloth covered foam (not shown) and contain cloth covered foam dividers with ends bearing hook and eye material so that the dividers may be selectively reconfigured to accommodate apparatus of various sizes and shapes. In use, straps 81 are folded over the inside of the front edge 82 so that they grab the cloth material of the liners. This provides several advantages in operation. First, when straps 81 are folded over the front edges 82 of bins 72, front flap 25 can be completely unzipped and yet will not fall to the ground as a result of the unzipping. Additionally, when the straps 81 are so configured, pulling flap 25 a short distance away from front edge 22 of top wall 15 causes the strap 81*a* to pull top bin 72 to its open position. However, the front flap 25 does not immediately fall. Therefore, rapid access to the interior of bin 72*a* may be obtained, and simply pushing flap 25 back toward front edge 22 causes the bin to rotate back to its home position.

Alternately, strap 81*a* can be disconnected and top portion 28*a* rotates about the hinge formed between reinforcing strips 30 (FIG. 1) and thus, about horizontal axis 31 (FIG. 3). In this configuration, strap 81*b* pulls bin 72*b* open but remains attached thereto. Thus, once again front flap 25 is prevented from falling all the way to the ground, and it is easy to pull same up to quickly close the bag.

Additionally, the configuration illustrated in FIG. 3 allows easy and convenient access to the pockets 85*a*–85*c* on top portion 28*a* of front flap 25.

In the preferred embodiment, pockets 85*a*–85*c* are formed of a continuous strip of cloth having vertically oriented strips of hook and eye material 86 that are connected to both a piece of fabric forming the pocket and mating strips that are connected to the inside of top portion 28*a*. Additionally, horizontally disposed strips of hook and eye material 88 are folded over the top and bottom edges of the material forming pockets 85. These edges are likewise lined with horizontally disposed strips of hook and eye material. The intended use of pockets 85 is to hold relatively small generally planer devices such as filters and spare lens caps. However, from the construction shown, it will be apparent that the material constituting pockets 85 is simply one piece of material with appropriate strips of hook and eye material sewn thereto. Therefore, if fabric strips 88 are folded back and pockets 85 are pulled away from the interior of front flap 25, the entire web pocket material may be removed. This serves to emphasize the simplicity of construction of this pocket arrangement. Also, if the user desires to store something slightly bigger than one of pockets 85, the hook and eye material strips between two adjacent pockets, such as 85*a* and 85*b*, may be pulled apart, and the larger device may be inserted into what is now the double width pocket that results from this operation.

A tray 90 is shown removed from the interior of bag with arrow 91 indicating where it is inserted when in its stored position. In the preferred embodiment, tray 90 is of a height substantially equal to a predetermined distance indicated by dimension line 92 (FIG. 5). It is sized to hold conventionally sized boxes in which rolls of 35mm film are typically sold. In FIG. 5, tray 90 is shown in its inserted position in the bottom of the bag, and lower bin 72*b* is shown removed from the interior. When assembled, through bolt 66*a* becomes journaled in hole 95*a*, shown in phantom in FIG. 5, on the right hand side of bin 72*b*. Similarly, through bolt 66*b* is journaled in hole 96*b* and thus, defines axis of rotation 75*b* (FIG. 3). The predetermined distance indicated by dimension line 92 is substantially equal to clearance between the bottom of bin 72*b* and bottom wall 16. Therefore, the tray can slide in and out of the interior of the bag when bin 72*b* is rotated to its home position.

Also, tray 90 has a characteristic predetermined tray depth indicated by dimension line 95 (FIG. 4). In the predetermined embodiment, there is a predetermined distance between back wall 17 and bolt 66, this predetermined distance being indicated by dimension line 96 shown in FIG. 5. In the preferred embodiment, the predetermined tray depth indicated by dimension line 95 is less than the distance indicated by dimension line 96 between the back wall and through bolt 66, which is also the distance between the back wall 17 and axis of rotation 75*b*. By maintaining this relationship, tray 90 can be snugly inserted into the interior of the bag so that its upper edges contact the bottom of bin 72*b* tending to hold it in place and keeping its contents from spilling out over the edges. At the same time, keeping the tray depth 95 less than the distance from the back wall 17 to the axis of rotation for the bin assures that the bin may be rotated out from its home position to its open position without being blocked by the tray when the tray is fully inserted.

From the foregoing description of the preferred embodiment, it will be apparent that the camera bag of the preferred embodiment is an extremely versatile device. It is designed to be carried in a plurality of ways including several configurations of shoulder straps, toteage by its conventional handle 48, and rolling on wheels 36 when U-shaped handle 41 is extended to the position shown in FIGS. 1 and 2. Additionally, bins 72 may be conveniently rotated between their home and open positions quickly and easily for access to their contents. The arrangement of front flap 25 is such that it may be fully unzipped, yet remain loosely connected to the bins via straps 81 when in use, for example, either set on the ground, or carried over the shoulder of the user. The bins 72 are fitted with means for holding them in their open and home positions. Cords 78 hold the bins in their open position and prevent dumping of the bin contents. Hook and eye strip 80, together with a mating strip disposed in detent 77, holds the bin in its home position. The side pouches are securely held on the side of the bag when installed as described hereinabove, yet may be quickly and easily removed if the user wishes to transport the side pouches separately or wear them on a belt, as described hereinabove.

The preferred embodiment is also sized and designed to be conveniently carried onto an airplane and fit under a seat on most airliners used by commercial air carriers.

From the foregoing description, it will be appreciated that the preferred embodiment of the present invention overcomes the drawbacks of prior art camera bags cited hereinabove and meets the objects of the invention noted above. From the description of the preferred embodiment, other embodiments of the present invention will suggest themselves to those skilled in the art and therefore, the scope of the present invention should be limited only by the claims below and equivalents thereof.

I claim:

1. A camera bag comprising in combination:

a substantially rectangular well comprising a pair of rigid opposing vertical side walls, a rigid top wall and an opposed rigid bottom wall that is substantially parallel to said top wall, each of said pair of rigid opposing vertical side walls, said top wall and said bottom wall having respective front and back edges, said back edges all being joined to a substantially rectangular vertical back wall;

a front flap having a bottom edge joined to said front edge of said bottom wall, a top edge, and a pair of vertical side edges;

means for selectively closing said camera bag by selectively securing said top edge, and said pair of vertical side edges of said front flap to said front edges of said top wall;

at least two wheels located proximate said rigid bottom wall;

a generally U-shaped handle disposed proximate said vertical back wall having two substantially parallel spaced elongated rod members, said rod members being slideably retractable along axes substantially parallel to said vertical back wall between an extended position and a retracted position:

at least one rigid bin pivotally mounted for rotation about an axis of rotation that is substantially perpendicular to said pair of rigid opposing vertical side walls between a home position and an open position.

2. A camera bag as recited in claim 1 wherein:

each of said substantially parallel spaced elongated rod members includes at least two telescoping sections.

3. A camera bag as recited in claim 1 wherein:

said rod members extend through said top wall so that said retracted position of said rod members is within the interior of said camera bag.

4. A camera bag as recited in claim 1 further comprising:

holding means for holding said rigid bin in said home position.

5. A camera bag as recited in claim 3 further comprising:

holding means for holding said rigid bin in said home position.

6. A camera bag as recited in claim 5 further comprising:

a pair of tubular guides located within the interior of said camera bag in which said rod members are journaled and wherein said rigid bin includes a back bin wall; and said holding means comprises means for selectively securing at least a portion of said back bin wall to at least one of said tubular guides.

7. A camera bag as recited in claim 5 further comprising:

a pair of tubular guides located within the interior of said camera bag in which said rod members are journaled and wherein said rigid bin includes a back bin wall with a pair of detents therein aligned to engage said pair of tubular guides when said bin is in said home position; and said holding means comprises hook and eye fasteners connected to said pair of detents and said pair of tubular guides.

8. A camera bag as recited in claim 1 wherein:

said rigid bin has a substantially planar floor that lies in a substantially horizontal plane a predetermined distance above said rigid bottom wall when said rigid bin is said home position, and further comprising:

a tray having a height substantially equal to said predetermined distance slideably engaged with said substantially planar floor of said rigid bin and said rigid bottom wall.

9. A camera bag as recited in claim 8 wherein:

said tray is characterized by a predetermined tray depth that is less than the distance from said vertical back wall to axis of rotation, thereby allowing said rigid bin to rotate from said home position to said open position when said tray is fully inserted into the interior of said camera bag.

10. A camera bag as recited in claim 1 further comprising at least one side pouch and connecting means for selectively connecting said side pouch to one of said vertical side walls and alternately for removing said side pouch from said one of said vertical side walls.

11. A camera bag as recited in claim 10 wherein:

said connecting means comprises vertically oriented strips of hook and eye fastener attached to said side pouch and said one of said vertical side walls.

12. A camera bag as recited in claim 11 wherein:

said connecting means further comprises a hook and stud fastener pair connected to said side pouch and said one of said vertical side walls above said strips of hook and eye fastener.

13. A camera bag as recited in claim 1 wherein:

at least a portion of said front flap has a plurality of pockets attached to the interior side thereof.

14. A camera bag as recited in claim 13 wherein:

said plurality of pockets comprise a substantially rectangular piece of cloth connected to said interior side of said front flap by a plurality of vertically arranged spaced apart strips of hook and eye fastener.

15. A camera bag comprising in combination:

a substantially rectangular well comprising a pair of rigid opposing vertical side walls, a rigid top wall and an opposed rigid bottom wall that is substantially parallel to said top wall, each of said pair of rigid opposing vertical side walls, said top wall and said bottom wall having respective front and back edges, said back edges all being joined to a substantially rectangular vertical back wall;

a front flap having a bottom edge joined to said front edge of said bottom wall, a top edge, and a pair of vertical side edges;

means for selectively closing said camera bag by selectively securing said top edge, and said pair of vertical side edges of said front flap to said front edges of said top wall;

at least two wheels located proximate said rigid bottom wall;

a generally U-shaped handle disposed proximate said vertical back wall having two substantially parallel spaced elongated rod members, said rod members being slideably retractable along axes substantially parallel to said vertical back wall between an extended position and a retracted position;

at least two rigid bins pivotally mounted for rotation about a pair of vertically spaced axes of rotation that are substantially perpendicular to said pair of rigid opposing vertical side walls between a home position and an open position.

16. A camera bag as recited in claim 15 wherein:

said front flap comprises at least two distinct reinforced portions joined at a hinge providing for relative movement of said two distinct reinforced portions about a horizontal axis.

17. A camera bag as recited in claim 16 further comprising:

a strap having a first end connected to the back side of said front flap near said hinge and a second end selectively connectable to the front edge of one of said rigid bins.

18. A camera bag as recited in claim 16 wherein:

at least one of said two distinct reinforced portions of said front flap has a plurality of pockets attached to the interior side thereof.

19. A camera bag as recited in claim 18 wherein:

said plurality of pockets comprise a substantially rectangular piece of cloth connected to said interior side of said front flap by a plurality of vertically arranged spaced apart strips of hook and eye fastener.

20. A camera bag as recited in claim 15 wherein:

said rod members extend through said top wall so that said retracted position of said rod members is within the interior of said camera bag.

21. A camera bag as recited in claim 15 further comprising:

holding means for holding said rigid bins in said home position.

22. A camera bag as recited in claim 20 further comprising:

holding means for holding said rigid bins in said home position.

23. A camera bag as recited in claim 22 further comprising a pair of tubular guides located within the interior of said camera bag in which said rod members are journaled and wherein each of said rigid bins includes a back bin wall and said holding means comprises means for selectively securing at least a portion of said back bin wall to at least one of said tubular guides.

24. A camera bag as recited in claim 22 further comprising a pair of tubular guides located within the interior of said camera bag in which said rod members are journaled and wherein said rigid bins includes a back bin wall with a pair of detents therein aligned to engage said pair of tubular guides when each of said bins is in said home position, and said holding means comprises hook and eye fasteners connected to said pair of detents and said pair of tubular guides.

25. A camera bag as recited in claim 15 wherein:

one of said rigid bins is a lowermost one of said rigid bins and said lowermost one of said rigid bins has a substantially planar floor that lies in a substantially horizontal plane a predetermined distance above said rigid bottom wall when said lowermost one of said rigid bins is said home position, and further comprising a tray having a height substantially equal to said predetermined distance slideably engaged with said substantially planar floor of said lowermost one of said rigid bins and said rigid bottom wall.

26. A camera bag as recited in claim 25 wherein:

said tray is characterized by a predetermined tray depth that is less than the distance from said vertical back wall to axis of rotation, thereby allowing said lowermost one of said rigid bins to rotate from said home position to said open position when said tray is fully inserted into the interior of said camera bag.

27. A camera bag as recited in claim 15 further comprising at least one side pouch and connecting means for selectively connecting said side pouch to one of said vertical side walls and alternately for removing said side pouch from said one of said vertical side walls.

28. A camera bag as recited in claim 27 wherein:

said connecting means comprises vertically oriented strips of hook and eye fastener attached to said side pouch and said one of said vertical side walls.

29. A camera bag as recited in claim 28 wherein:

said connecting means further comprises a hook and stud fastener pair connected to said side pouch and said one of said vertical side walls above said strips of hook and eye fastener.

* * * * *